US005165768A

United States Patent [19]

Zarrabi et al.

[11] Patent Number: 5,165,768

[45] Date of Patent: Nov. 24, 1992

[54] DISPLAY CASE SECURITY APPARATUS

[76] Inventors: Farzin Zarrabi, P.O. Box 28418; Ahmad Sedehi, P.O. Box 270215, both of San Diego, Calif. 92198

[21] Appl. No.: 660,611

[22] Filed: Feb. 25, 1991

[51] Int. Cl.[5] ..... A47B 88/00

[52] U.S. Cl. ..... 312/114; 109/54; 109/58.5; 312/139; 312/204

[58] Field of Search ..... 312/114, 204, 319, 138.1, 312/139; 109/54, 58.5

[56] References Cited

U.S. PATENT DOCUMENTS 1,787,809 1/1931 Allen et al. ..... 312/114
3,716,281 2/1973 Rudder ..... 312/114

FOREIGN PATENT DOCUMENTS 643292 11/1927 France ..... 109/54

*Primary Examiner*—Joseph Falk

[57] ABSTRACT

A display case security apparatus has a lower chamber having a top partition wall and a bottom wall. There is an upper chamber. A partition wall has a plurality of ports therethrough that provide access between the lower chamber and upper chamber. There is at least one trapdoor, hingingly connected to the partition wall. There is at least one trapdoor biasing device, that has one end attached to the trapdoor and that has another end attached to the bottom wall. At least one security door, slidably attached to the partition wall, slidingly closes the ports when the trapdoor has moved to the open position. There is at least one security door biasing device that has one end attached to the partition wall and that has another end attached to the security door. The security door is secured in an open position by at least one first lock device attached to the partition wall. A trapdoor releasing device, attached to the partition wall, comprises at least one release lug, at least one first release actuator and at least one release lug rod connecting the release lugs and the release actuator to rotate the lugs and allow the trapdoors to move from the closed position to the open position. There is a sensor circuit to electronically actuate the trapdoor releasing device and the first lock release device.

6 Claims, 5 Drawing Sheets

DISPLAY CASE SECURITY APPARATUS

BACKGROUND OF THE INVENTION

1. Field of the Invention

This invention relates to an apparatus for safeguarding valuables and especially jewelry that are displayed in a display case for public viewing. The invention is especially useful in deterring the loss of jewelry due to a technique known as "Smash and Grab" whereby the display case is broken and the valuables gathered up quickly. The thieves are usually in the store for a very short time and then are gone before an alarm can bring the police. Once the integrity of the usually transparent upper case is broken, the apparatus quickly removes the valuables to the lower security vault chamber of the apparatus thus greatly reducing the chance of the thieves obtaining the valuables.

2. Description of the Related Art

U.S. Pat. No. 3,716,281 to J. M. Rudder, Jr. on Feb. 13, 1973 shows a security display case having a panel that swings from a position on top of the glass of a display case to a position under the glass of the display case allowing the salesperson to quickly place the jewelry on the panel under the glass of the case.

A European Patent No. 0,133,857 to A. Messina on Mar. 13, 1985 describes a photoelectric or key activated device to automatically secure the doors of a display case.

A French Patent No. 2,603,787 to F. Deshayes on Mar. 18, 1988 shows a motorized sliding security door for a display case. The case has an upper part to house the motor and a lower part for display.

SUMMARY OF THE INVENTION

A display case security apparatus is described that has a lower chamber having a plurality of lower walls and an upper chamber, attached to the lower chamber, having a plurality of upper walls. One of the lower walls has a plurality of ports therethrough that provide access between the lower chamber and upper chamber. There is a trapdoor means, connected to one of the lower walls, that moves from a closed position closing the ports to an open position opening the ports. The valuables are placed within the ports in the partition and rest on the trapdoors. Whe the trapdoors swing open, the valuable are pulled through the ports and are deposited in the lower chamber.

A display case security apparatus may have at least one security door, attached to one of the lower walls, that closes the ports when the trapdoor means has moved to the open position. The lower walls may be described in more detail as being a first lower side wall, a second lower side wall, a third lower side wall, a fourth lower side wall, bottom wall and a top partition wall. The upper walls may be described in more detail as being a first upper side wall, a second upper side wall, a third upper side wall, a fourth upper side wall and a top wall.

Another display case security apparatus is described that has a lower chamber that has a first lower side wall, a second lower side wall, a third lower side wall, a fourth lower side wall, bottom wall and a top partition wall. An upper chamber of the apparatus, attached to the lower chamber, has a first upper side wall, a second upper side wall, a third upper side wall, a fourth upper side wall and a top wall. There is a partition wall that has a plurality of ports therethrough that provide access between the lower chamber and upper chamber.

This apparatus has at least one trapdoor, hingingly connected to the partition wall, that moves from a closed position closing the ports to an open position opening the ports. There is at least one trapdoor biasing means, that has one end attached to the trapdoor and has another end attached to the bottom wall, to bias the trapdoor to the open position.

At least one security door, slidably attached to the partition wall, slidingly closes the ports when the trapdoor means has moved to the open position. There is at least one security door biasing means that has one end attached to the partition wall and has another end attached to the security door. The security door biasing means biases the security door to a closed position. The security door is releasingly secured in an open position by at least one first lock means attached to the partition wall.

A trapdoor releasing means, attached to the partition wall, comprises at least one release lug, at least one first release actuator and at least one release lug rod connecting the release lugs and the release actuator to rotate the lugs and allow the trapdoors to move from the closed position to the open position.

It is an object of this invention to provide a quickly and automatically actuated security system that removes valuables from an upper display chamber to a lower vault chamber to reduce the chance of theft when the upper chamber is broken into yet still allow normal sales operations to continue until the integrity of the case is violated.

DESCRIPTION OF THE PREFERRED EMBODIMENT

Figure 1:
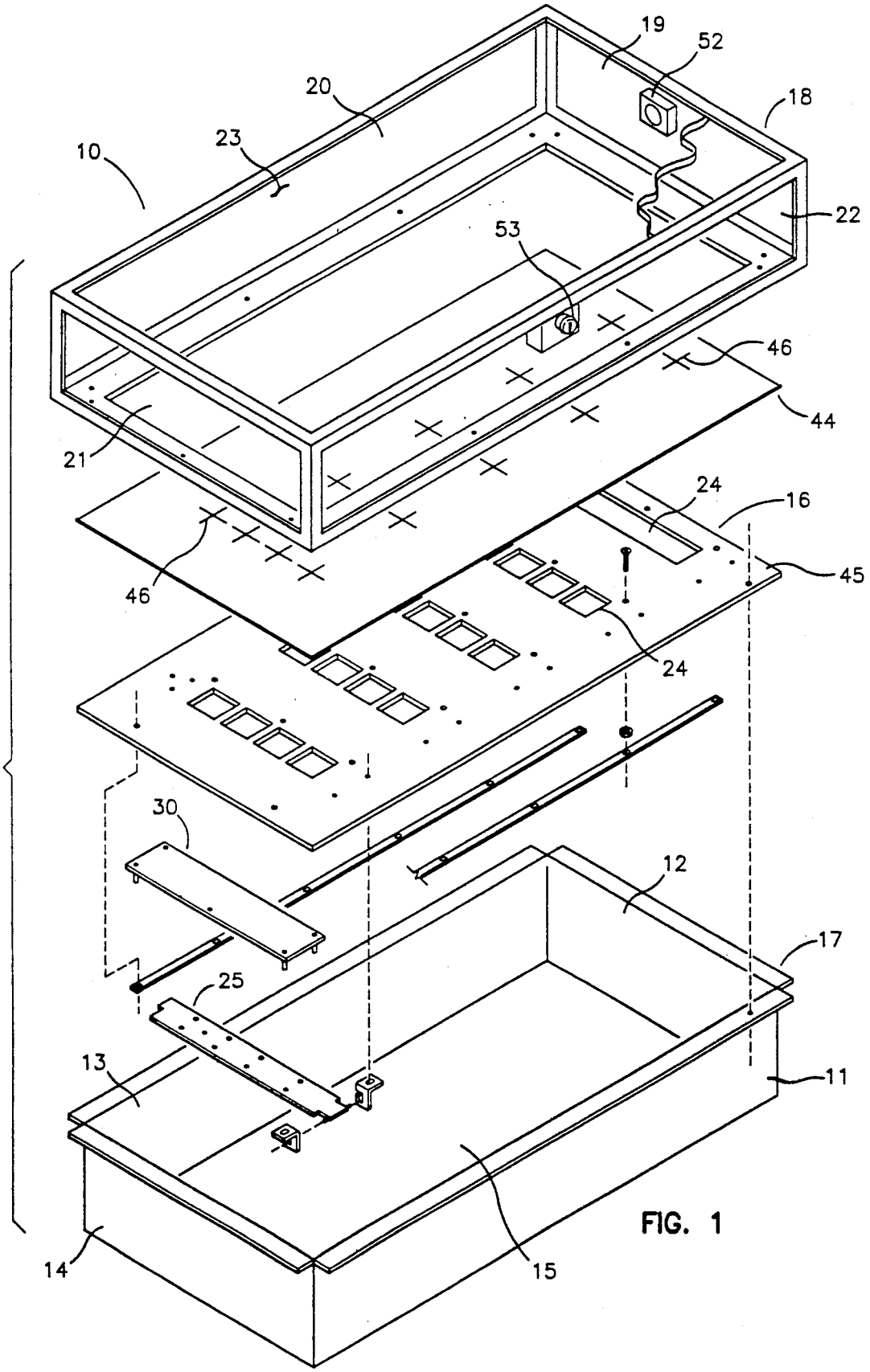
FIG. 1 is an exploded perspective view showing the upper and lower chambers of the Display Case Security Apparatus.
Figure 2:
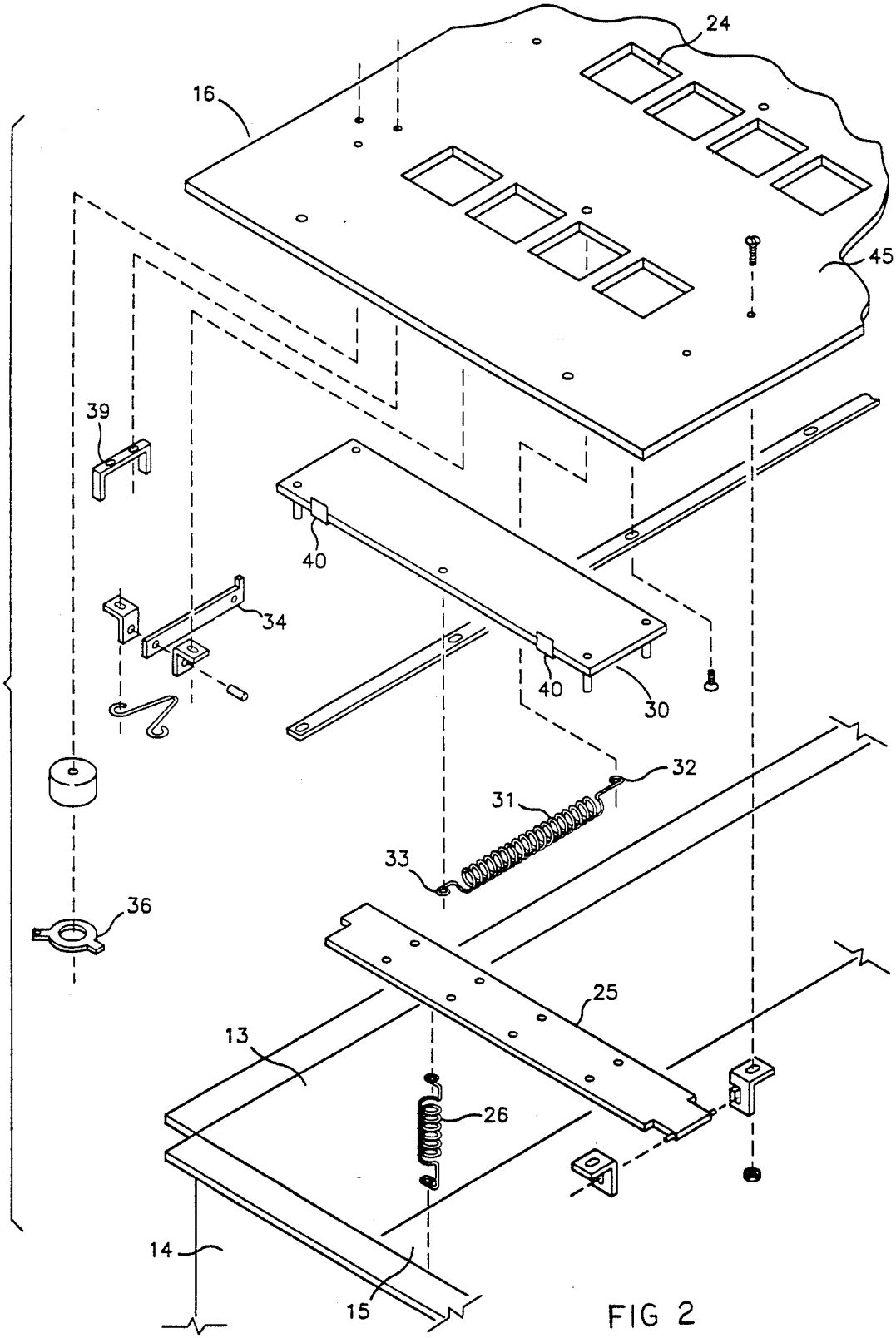
FIG. 2 is an enlarged, exploded, partial view of FIG. 1 showing the first lock means and the trapdoor biasing means.

A display case security apparatus 10, as shown in FIGS. 1 through 7 has a lower chamber 17 having a first lower side wall 11, a second lower side wall 12, a third lower side wall 13, a fourth lower side wall 14, bottom wall 15 and a top partition wall 16. An upper chamber 18, attached to the lower chamber 17, has a first upper side wall 19, a second upper side wall 20, a third upper side wall 21, a fourth upper side wall 22 and a top wall 23. The partition wall 16 has a plurality of ports 24 therethrough that provide access between the lower chamber 17 and upper chamber 18.

There is at least one trapdoor 25, hingingly connected to the partition wall 16, that moves from a closed position (shown in FIGS. 3 and 5) closing the ports 24 to an open position (shown in FIG. 6) opening the ports 24. There is at least one trapdoor biasing means 26 (shown in FIGS. 5 and 6 as a spring), having one end 27 attached to the trapdoor 25 and having another end 28 attached to the bottom wall 15, to bias the trapdoor 25 to the open position. At least one trapdoor stop means 29 is attached to the bottom wall 15 to limit the travel o the trapdoor.

Figure 3:
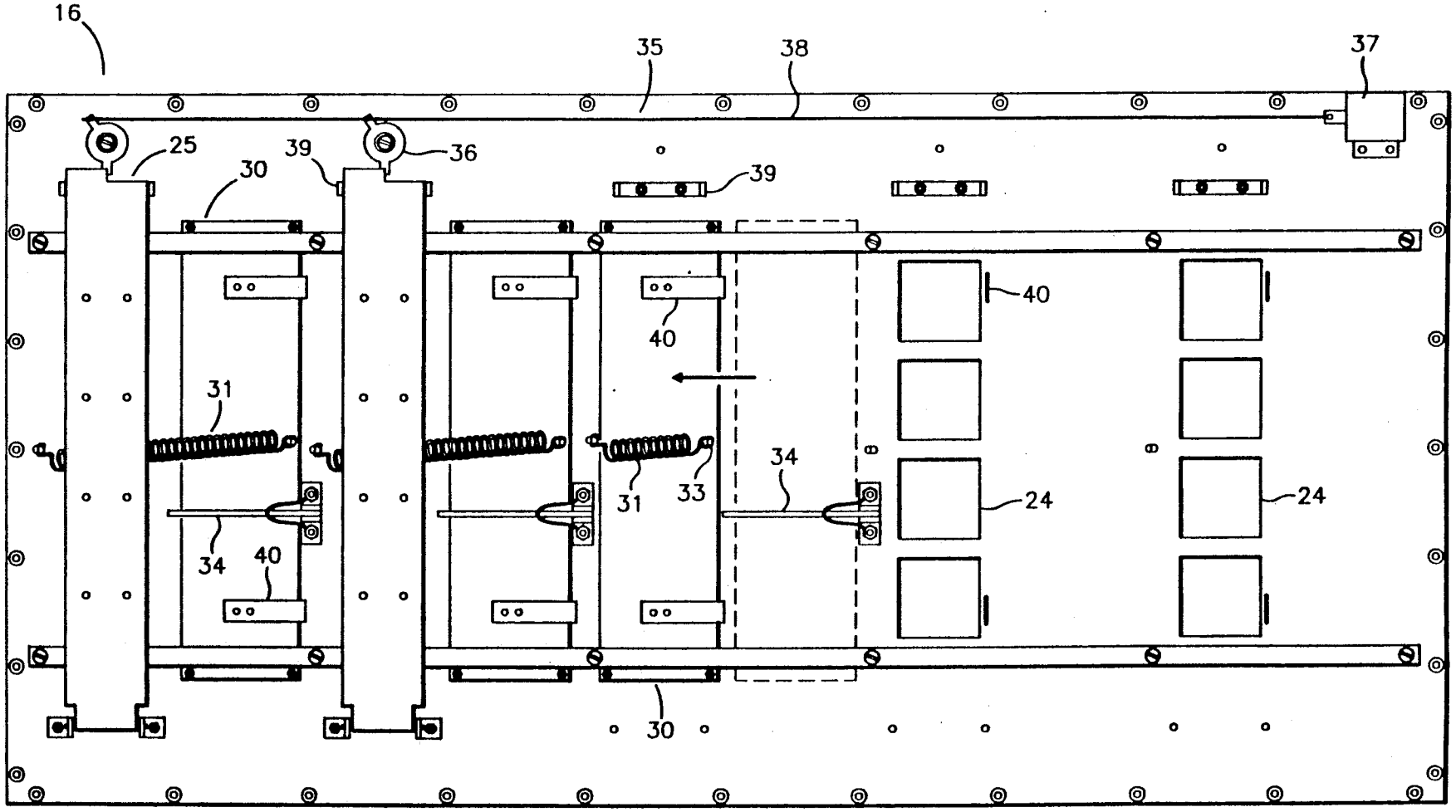
FIG. 3 is a bottom view of the partition wall showing the trapdoors held in the closed position by the trapdoor releasing means and showing one of the security doors moved from the closed position to the open position.
Figure 4:
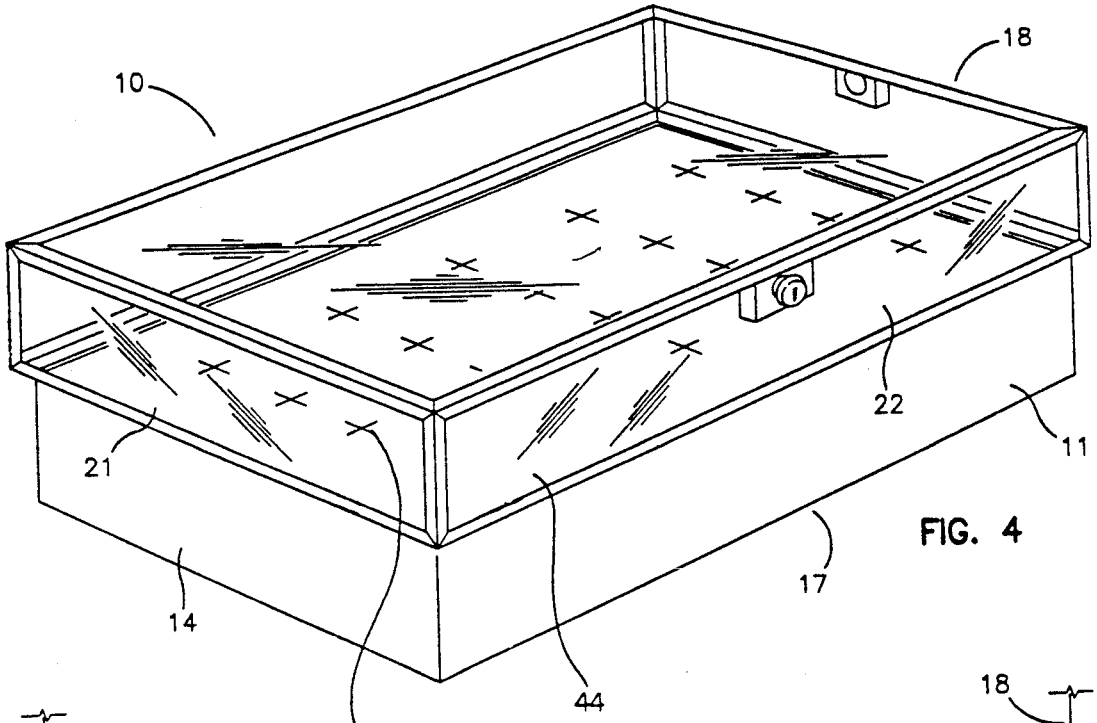
FIG. 4 is a perspective view of the display case security apparatus.
Figure 5:
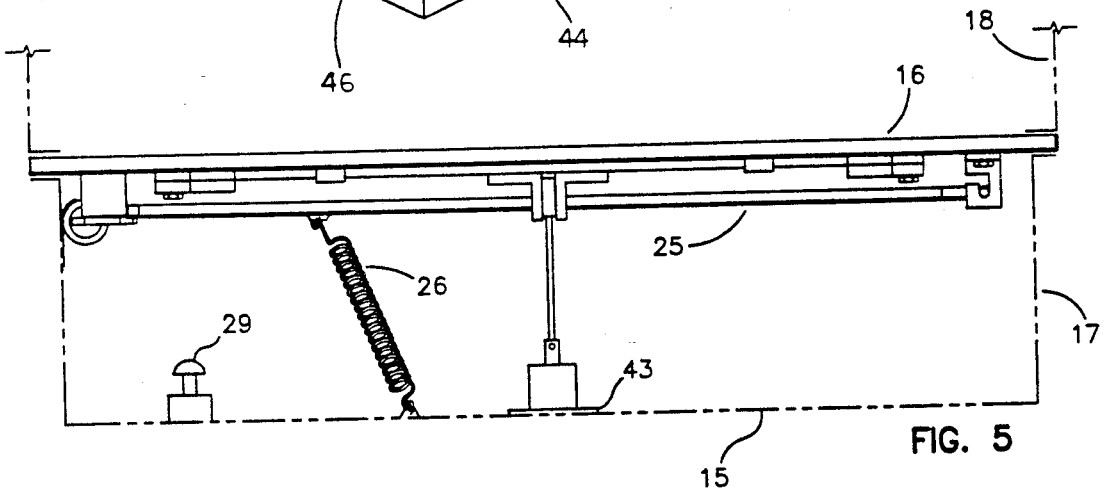
FIG. 5 is a partial side view of the partition wall showing part of the display case in phantom. The trapdoor is shown in the closed position and the first lock release means is shown.
Figure 6:
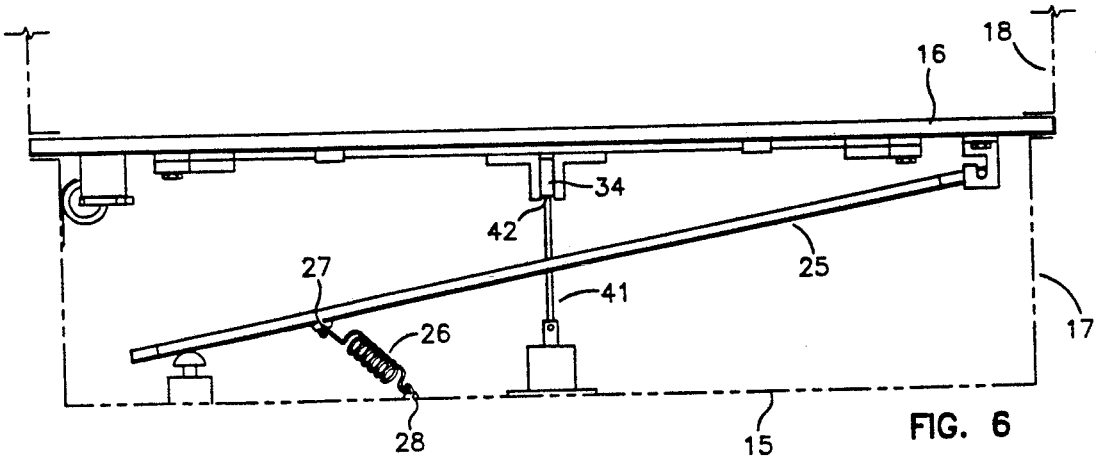
FIG. 6 is a partial side view of the partition wall showing part of the display case in phantom. The trapdoor is shown in the open position.
Figure 7:
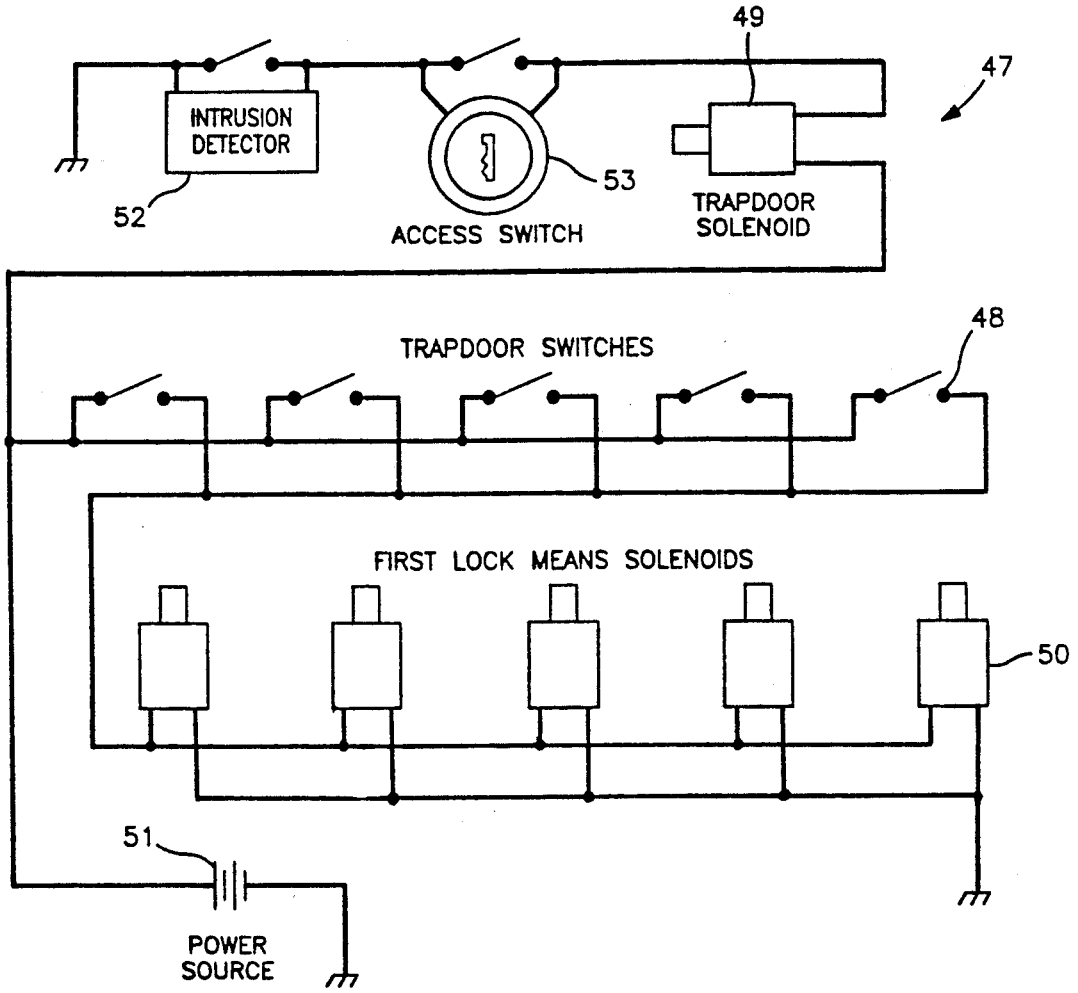
FIG. 7 is a block diagram of the sensor circuit.

There is at least one security door 30, slidably attached to the partition wall 16, that slidingly closes the ports 24 when the trapdoor 25 has moved to the open position. This is best shown in FIG. 3. At least one security door biasing means 31 (shown in FIGS. 2 and 3 as a spring), has one end 32 attached to the partition wall 16 and has another end 33 attached to the security door 30. The security door biasing means 31 biases the security door 30 to a closed position (shown in FIG. 3). The security door 30 is secured in an open position (shown in FIG. 3) by at least one first lock means 34 attached to the partition wall 16.

There is a trapdoor releasing means 35 (shown in FIG. 3), attached to the partition wall 16, that comprises at least one release lug 36, at least one first release actuator 37 and at least one release lug rod 38 connecting the release lugs 36 and the release actuator 37 to rotate the lugs 38 and allow the trapdoors 25 to move from the closed position to the open position. At least one trapdoor guide 39 is attached to the partition wall 16 to align the trapdoor 25 in the closed position.

There is at least one second lock means 40, attached to the security door 30, to lock the security door in the closed position. There is at least one first lock release means 41, having one end 42 attached to the first lock means 34 and having another end 43 attached to the bottom wall 15, to move the first lock means 34 from a locked position to an unlocked position (shown in FIGS. 5 and 6).

A cover 44, intimately engaged on a top surface 45 of the partition wall 16, has cover ports 46 (see FIG. 1) therethrough which align with the ports 24 in the partition wall 16. There is a sensor circuit 47 to electronically actuate the trapdoor releasing means 35 and the first lock release means 34. There is at least one trapdoor switch 48 and at least one trapdoor solenoid 49 in the circuit 47. There is at least one first lock means solenoid 50 and a power source 51 connected to the circuit 47 to provide power to the circuit. There is at least one intrusion sensor 52, in the sensor circuit 47, to actuate the trapdoor switches 48, the trapdoor solenoids 49 and the first lock means solenoids 50. There is an interruption switch 53 , in the circuit 47, to disable the intrusion sensor 52.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A display case security apparatus comprising:

a. a lower chamber having a first lower side wall, a second lower side wall, a third lower side wall, a fourth lower side wall, a bottom wall and a top partition wall;

b. an upper chamber, attached to the lower chamber, having a first upper side wall, a second upper side wall, a third upper side wall, a fourth upper side wall and a top wall;

c. said partition wall having a plurality of ports therethrough providing access between the lower chamber and upper chamber;

d. a trapdoor means, connected to said partition wall, movable from a first position closing the ports to a second position opening the ports;

e. at least one security door slidingly attached to said partition wall for closing the ports when said trapdoor means has moved to the second position; and f. means for sliding said security door when trap door moves from said first position to said second position.

2. A display case security apparatus as described in claim 1 wherein said means for sliding said security door is a spring extending between said partition and said security door.

3. A display case security apparatus as described in claim 2 further comprising a trapdoor release means attached to the partition wall, said release means comprises at least one first release actuator and at least one release lug rod connecting the release actuator to rotate the lugs and allow the trapdoors to move from the first closed position to the second open position.

4. A display case security apparatus as described in claim 1 further comprising a trapdoor release means attached to the partition wall, said release means comprises at least one first release actuator and at least one release lug rod connecting the release actuator to rotate the lugs and allow the trapdoors to move from the first closed position to the second open position.

5. A display case security apparatus comprising:

a. a lower chamber having a first lower side wall, a second lower side wall, a third lower side wall, a fourth lower side wall, bottom wall and a top partition wall;

b. an upper chamber, attached to the lower chamber, having a first upper side wall, a second upper side wall, a third upper side wall, a fourth upper side wall and a top wall;

c. the partition wall having a plurality of ports therethrough providing access between the lower chamber and upper chamber;

d. at least one trapdoor, hingingly connected to the partition wall, moving from a closed position closing the ports to an open position opening the ports;

e. at least one trapdoor biasing means, having one end attached to the trapdoor and having another end attached to the bottom wall, to bias the trapdoor to the open position;

f. at least one security door, slidably attached to the partition wall, slidingly closing the ports when the trapdoor means has moved to the open position;

g. at least one security door biasing means, having one end attached to the partition wall and having another end attached to the security door;

h. the security door biasing means biasing the security door to a closed position;

i. the security door releasingly secured in an open position by at least one first lock means attached to the partition wall; and j. a trapdoor releasing means, attached to the partition wall, comprising at least one release lug, at least one first release actuator and at least one release lug rod connecting the release lugs and the release actuator to rotate the lugs and allow the trapdoors to move from the closed position to the open position.

6. A display case security apparatus comprising:

a. a lower chamber having a first lower side wall, a second lower side wall, a third lower side wall, a fourth lower side wall, bottom wall and a top partition wall;

b. an upper chamber, attached to the lower chamber, having a first upper side wall, a second upper side wall, a third upper side wall, a fourth upper side wall and a top wall;

c. the partition wall having a plurality of ports therethrough providing access between the lower chamber and upper chamber;

d. at least one trapdoor, hingingly connected to the partition wall, moving from a closed position closing the ports to an open position opening the ports;

e. at least one trapdoor biasing means, having one end attached to the trapdoor and having another end attached to the bottom wall, to bias the trapdoor to the open position;

f. at least one trapdoor stop means, attached to the bottom wall, to limit the travel of the trapdoor;

g. at least one security door, slidably attached to the partition wall, slidingly closing the ports when the trapdoor means has moved to the open position;

h. at least one security door biasing means, having one end attached to the partition wall and having another end attached to the security door;

i. the security door biasing means biasing the security door to a closed position;

j. the security door releasingly secured in an open position by at least one first lock means attached to the partition wall;

k. a trapdoor releasing means, attached to the partition wall, comprising at least one release lug, at least one first release actuator and at least one release lug rod connecting the release lugs and the release actuator to rotate the lugs and allow the trapdoors to move from the closed position to the open position;

l. at least one trapdoor guide, attached to the partition wall, to align the trapdoor in the closed position;

m. at least one second lock means, attached to the security door, to lock the security door in the closed position;

n. at least one first lock release means, having one end attached to the first lock means and having another end attached to the bottom wall, to move the first lock means from a locked position to an unlocked position;

o. a cover, intimately engaged on a top surface of the partition wall, having cover ports therethrough which align with the ports in the partition wall;

p. a sensor circuit to electronically actuate the trapdoor releasing means and the first lock release means;

q. at least one trapdoor switch in the circuit;

r. at least one trapdoor solenoid in the circuit;

q. at least one first lock means solenoid in the circuit;

s. a power source connected to the circuit to provide power to the circuit;

t. at least one intrusion sensor, in the sensor circuit, to actuate the trapdoor switches, trapdoor solenoids and the first lock means solenoids; and u. an interruption switch, in the circuit, to disable the intrusion sensor.

* * * * *